US011092363B2

(12) United States Patent
Bilbow

(10) Patent No.: US 11,092,363 B2
(45) Date of Patent: Aug. 17, 2021

(54) LOW BACK PRESSURE FLOW LIMITER

(71) Applicant: Danfoss A/S, Nordborg (DK)

(72) Inventor: William M. Bilbow, Tallahassee, FL (US)

(73) Assignee: DANFOSS A/S

( * ) Notice: Subject to any disclaimer, the term of this patent is extended or adjusted under 35 U.S.C. 154(b) by 223 days.

(21) Appl. No.: 15/933,466

(22) Filed: Mar. 23, 2018

(65) Prior Publication Data

US 2018/0283736 A1 Oct. 4, 2018

Related U.S. Application Data

(60) Provisional application No. 62/481,227, filed on Apr. 4, 2017.

(51) Int. Cl.

| | |
|---|---|
| ***F25B 1/053*** | (2006.01) |
| ***F25B 11/00*** | (2006.01) |
| ***F25B 31/02*** | (2006.01) |
| ***F04D 27/02*** | (2006.01) |
| ***F04D 29/42*** | (2006.01) |

(52) U.S. Cl.

CPC ..... *F25B 1/053* (2013.01); *F04D 27/0253* (2013.01); *F04D 27/0269* (2013.01); *F25B 11/00* (2013.01); *F25B 31/026* (2013.01); *F04D 29/4226* (2013.01); *F25B 2500/07* (2013.01)

(58) Field of Classification Search

CPC ..... F25B 1/053; F25B 31/026; F25B 11/00; F25B 2500/07; F25B 41/00; F04D 27/0253; F04D 27/0269; F04D 29/4226; F04D 15/0077; F04D 15/0083; F04D 15/0005; F04D 2240/24; F04D 2240/242; F05B 2270/1081; F05B 2270/101; F16K 15/025; F16K 15/026; F16K 15/08; F16K 15/10; F16K 15/12; F16K 15/188; F16K 41/026; F16K 41/043; F16K 41/046; F16K 47/02; F16K 47/023; F16K 99/0013; F16K 15/063; F16K 1/126; F16K 47/12; F16K 47/14; F16K 16/063; F16K 1/261; F16K 47/00; F16K 47/026; F16K 47/04; F16K 47/045; F16K 47/06; F16K 47/08; F16K 47/10; F02B 2037/125; F25J 1/0298; F05D 2270/101

USPC ..... 62/401; 137/53, 56, 119.07, 323, 330, 137/331, 332, 499, 601, 808, 876, 887; 251/88, 149.2

See application file for complete search history.

(56) References Cited

U.S. PATENT DOCUMENTS

| | | | | |
|---|---|---|---|---|
| 1,759,081 A * | 5/1930 | Anderson | F16K 15/04 137/331 |
| 3,604,265 A * | 9/1971 | Wilson, Jr. | G01F 1/10 73/861.352 |
| 4,743,161 A | 5/1988 | Fisher et al. | |

(Continued)

FOREIGN PATENT DOCUMENTS

RU 2066849 C1 * 9/1996

*Primary Examiner* — Steve S Tanenbaum

(74) *Attorney, Agent, or Firm* — Carlson, Gaskey & Olds, P.C.

(57) ABSTRACT

One exemplary embodiment of this disclosure relates to a compressor system. The system includes a compressor and a back-flow limiting device. The back-flow limiting device has a turbine wheel and is arranged downstream of the compressor.

20 Claims, 2 Drawing Sheets

(56) References Cited

U.S. PATENT DOCUMENTS

| | | | | |
|---|---|---|---|---|
| 5,113,900 | A * | 5/1992 | Gilbert | F16K 15/063 137/515.5 |
| 5,236,301 | A | 8/1993 | Palmer | |
| 5,320,181 | A | 6/1994 | Lantier, Sr. et al. | |
| 5,875,637 | A * | 3/1999 | Paetow | F25B 39/02 62/117 |
| 6,079,449 | A * | 6/2000 | Gerber | B65D 47/2081 137/512.3 |
| 6,981,838 | B2 | 1/2006 | McKee et al. | |
| 7,091,628 | B1 * | 8/2006 | Balt | F03B 17/00 290/43 |
| 9,091,356 | B2 * | 7/2015 | Yang | F16K 1/126 |
| 2009/0120116 | A1 * | 5/2009 | Fuselier | F25B 11/04 62/238.6 |
| 2009/0178790 | A1 * | 7/2009 | Schreiber | F28D 21/0017 165/158 |
| 2010/0199661 | A1 * | 8/2010 | Johansson | F16J 15/186 60/525 |
| 2011/0036408 | A1 * | 2/2011 | Desai | F16K 15/063 137/1 |

* cited by examiner

LOW BACK PRESSURE FLOW LIMITER

RELATED APPLICATIONS

This application claims the benefit of U.S. Provisional Application No. 62/481,227, filed Apr. 4, 2017, the entirety of which is herein incorporated by reference.

BACKGROUND

This disclosure relates to a low back-pressure flow limiter for use in HVAC chiller systems.

Known chiller systems include a refrigerant circuit and a water circuit. Heat is exchanged between the refrigerant and water circuits. The refrigerant circuit includes a compressor that pressurizes a working fluid. One such compressor is a centrifugal compressor. Centrifugal compressors include an impeller driven by a motor. Fluid flows into the impeller in an axial direction, and is radially expelled from the inlet. The fluid is then directed downstream for use in the chiller system.

The fluid upstream of the compressor is at a low pressure, and the fluid downstream of the compressor is at a high pressure. Some known systems include a spring-activated back pressure check valve to prevent the high pressure fluid from flowing backward.

SUMMARY

One exemplary embodiment of this disclosure relates to a compressor system. The system includes a compressor and a back-flow limiting device. The back-flow limiting device has a turbine wheel and is arranged downstream of the compressor.

Another exemplary embodiment of this disclosure relates to a chiller. The chiller includes a compressor and a back-flow limiting device. The back-flow limiting device has a turbine wheel and is arranged downstream of the compressor.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
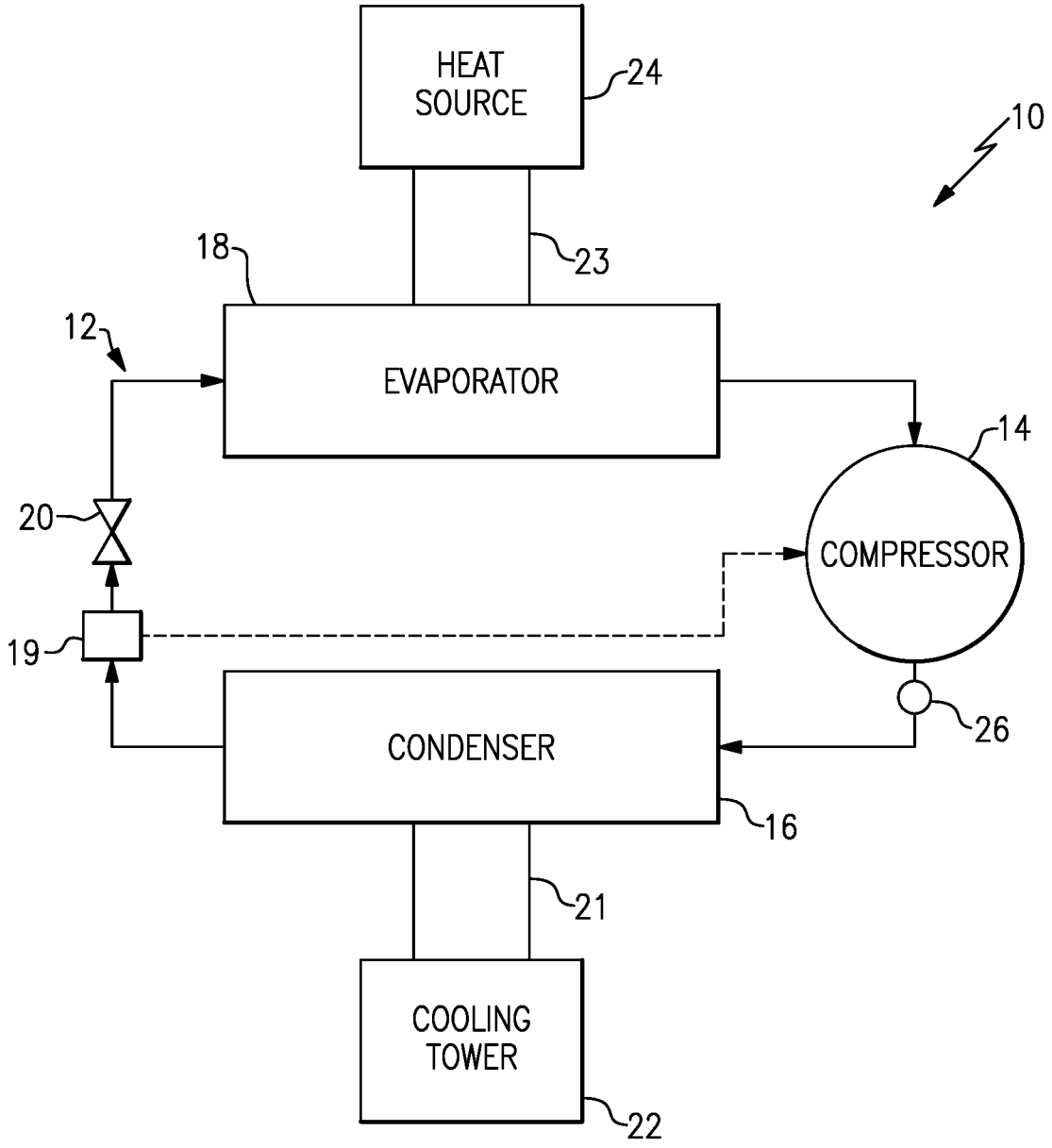
FIG. 1 shows a schematic view of a chiller.

FIG. 1 illustrates an exemplary compressor system 10. In this illustrated embodiment, the system 10 is a chiller system, which includes a main refrigerant loop, or circuit, 12 in communication with a compressor 14, a condenser 16, an evaporator 18, and an expansion device 20. While a particular example of the refrigerant loop 12 is shown, this application extends to other refrigerant loop configurations. For instance, the refrigerant loop 12 can include an economizer 19 downstream of the condenser 16 and upstream of the expansion device 20. The compressor 14 may be a centrifugal compressor or an axial flow compressor, for example. Although the illustrated system 10 is a chiller system, the teachings of this disclosure may apply to other types of compressor systems.

The chiller system 10 also includes a secondary fluid in loops 21, 23. In an embodiment, the secondary fluid is water. The condenser 16 includes a large barrel of water at a high temperature that is in communication with a cooling tower 22 via fluid loop 21. The evaporator 18 includes a large barrel of water at a low temperature that is in communication via loop 23 with a heat source 24, such as a room to be cooled. This chiller system 10 may be used in an HVAC system, for example.

The working fluid in the main refrigerant loop 12 has a low temperature and pressure at the evaporator 18, and a high temperature and pressure at the condenser 16. In one example chiller system 10, the working fluid in the main loop has a temperature of about 35° F. at the evaporator and a temperature of about 120° F. at the condenser. This working fluid may have a pressure of about 30 psi upstream of the compressor and about 150 psi downstream of the compressor. This pressure differential across the compressor 14 can lead to surge conditions. When surge occurs, the working fluid may flow backwards from the condenser 16 into the compressor 14, resulting in unsteady flow of the working fluid and a delay in compressor pumping recovery.

A back-flow limiting device 26 is located downstream of the compressor 14. The back-flow limiting device helps to prevent backflow and helps to reduce the amount of time for the compressor 14 to recover from surge.

Figure 2:
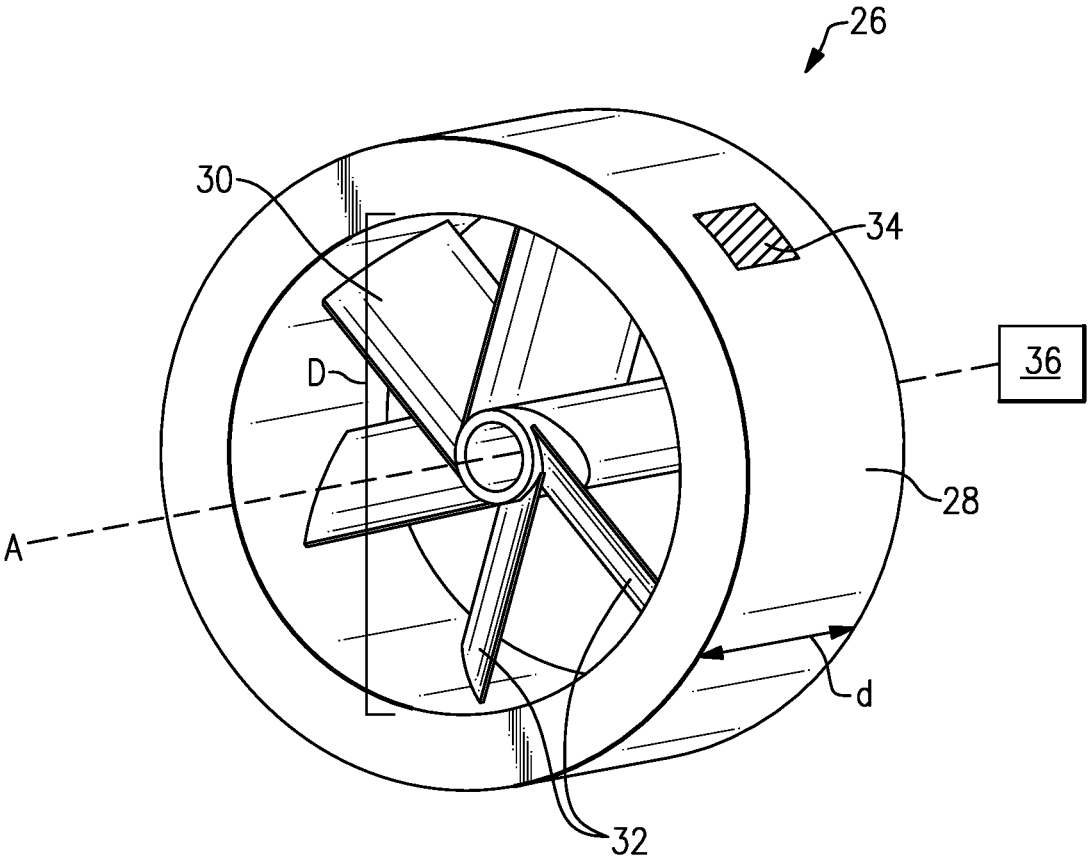
FIG. 2 shows a back flow limiter according to this disclosure.

One example back-flow limiting device 26 is shown in FIG. 2. The device 26 includes a pipe body 28 and a single-stage axial turbine-bladed wheel 30 having a plurality of blades 32. The quantity of blades 32 is selected to provide the best backflow control for a particular system. In one example, the device 26 has between 6 and 32 blades. In a further example, the device 26 has 6 blades. The blade angle and aspect ratio are also chosen based on the particular system. The wheel 30 rotates about an axis A. The pipe body 28 has a diameter D and a depth d, which define an aspect ratio of D:d. In an embodiment, the aspect ratio D:d is between 0.5 and 3. In some embodiments, the device 26 may include an inductive pickup 34 (shown schematically) mounted radially to detect the blade passes during rotation or a magnetic clutch 36 (shown schematically) to control or lock the turbine wheel 30 when desirable.

Known spring-activated back-flow limiters require the working fluid to reach a particular pressure differential before the limiter is activated. The back-flow limiting device 26 is able to limit back flow with a near zero-pressure differential between the working fluid upstream and downstream of the device 26. For example, the device 26 controls back-flow with a back pressure differential of less than about 1 psi at maximum rated volumetric flow. In a further embodiment, the device 26 controls back-flow with a back pressure differential of less than about 0.5 psi. In a further embodiment, the device 26 controls back-flow with a back pressure differential of about 0.25 psi.

As the compressor 14 imparts work on the working fluid resulting in mass flow, the mass passes through the turbine wheel 30 causing rotation. During normal operation of the system 10, the turbine wheel 30 spins freely. The device 26 dynamically restricts back-flow during surge. When the flow of the working fluid becomes unsteady, the turbine wheel 30 will transiently decelerate, as the turbine wheel 30 acts as a compressor. The turbine wheel 30 is imparting work on the working fluid because the flow vector is at a higher incidence angle to the blades 32 than along the zero lift line, causing deceleration. This compression characteristic lowers the head on the system primary compressor 14, assisting in surge recovery or delay. Effectively, in the event that the flow of working fluid becomes unsteady, the turbine wheel 30 keeps turning for a few seconds due to inertia. These few seconds of the wheel 30 turning help prevent back-flow while the system 10 recovers. Usually, the system 10 will have time to recover from a surge event before the turbine wheel 30 stops turning.

It should be understood that terms such as "axial" and "radial" are used above with reference to the normal operational attitude of a compressor. Further, these terms have been used herein for purposes of explanation and should not be considered otherwise limiting. Terms such as "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A compressor system, comprising:

a compressor; and a back-flow limiting device having a single-stage turbine wheel arranged downstream of the compressor, the single-stage turbine wheel configured to spin freely during normal operation, wherein the single-stage turbine wheel is configured to rotate about an axis that is parallel to a flow of fluid.

2. The compressor system of claim 1, wherein the back-flow limiting device comprises a pipe body that houses the turbine wheel.

3. The compressor system of claim 2, wherein an aspect ratio of a diameter of the pipe body to a depth of the pipe body is between 0.5 and 3.

4. The compressor system of claim 1, wherein the turbine wheel comprises a plurality of blades.

5. The compressor system of claim 4, wherein the turbine wheel comprises between 6 and 32 blades.

6. The compressor system of claim 1, wherein the back-flow limiting device is configured to have a back pressure differential of less than about 1 psi at a maximum rated volumetric flow.

7. The compressor system of claim 6, wherein the back-flow limiting device is configured to have a back pressure differential of less than about 0.5 psi.

8. The compressor system of claim 6, wherein the back pressure differential is about 0.25 psi.

9. The compressor system of claim 1, wherein the compressor is a centrifugal compressor.

10. The compressor system of claim 1, wherein the compressor is an axial flow compressor.

11. The compressor system of claim 1, wherein the back-flow limiting device has an inductive pickup.

12. The compressor system of claim 1, wherein the back-flow limiting device has a magnetic clutch.

13. A chiller, comprising:

a compressor; and a back-flow limiting device having a single-stage turbine wheel arranged downstream of the compressor, the single-stage turbine wheel configured to spin freely during normal operation of the chiller, wherein the single-stage turbine wheel is configured to rotate about an axis that is parallel to a flow of fluid.

14. The chiller of claim 13, comprising an economizer downstream of the compressor.

15. The chiller of claim 13, wherein the back-flow limiting device comprises a pipe body that houses the turbine wheel.

16. The chiller of claim 13, wherein the back-flow limiting device is configured to have a back pressure differential of less than about 1 psi.

17. The chiller of claim 13, wherein the back-flow limiting device has an inductive pickup.

18. The chiller of claim 13, wherein the back-flow limiting device has a magnetic clutch.

19. The chiller of claim 13, wherein the compressor is a centrifugal compressor.

20. The chiller of claim 13, wherein the compressor is an axial flow compressor.

* * * * *